United States Patent [19]

Egashira

[11] Patent Number: 4,862,182

[45] Date of Patent: Aug. 29, 1989

[54] ANTENNA FOR A PORTABLE RADIOTELEPHONE

[75] Inventor: Yoshimi Egashira, Kanagawa, Japan

[73] Assignee: Harada Kogyo Kabushiki Kaisha, Tokyo, Japan

[21] Appl. No.: 216,824

[22] Filed: Jul. 8, 1988

[30] Foreign Application Priority Data

Jul. 10, 1987 [JP] Japan ..... 62-106069[U]

[51] Int. Cl.[4] ..... H01Q 1/24

[52] U.S. Cl. ..... 343/702; 343/900; 343/903

[58] Field of Search ..... 343/702, 900, 903

[56] References Cited

U.S. PATENT DOCUMENTS

| | | | |
|---|---|---|---|
| 3,087,117 | 4/1963 | Mitchell | 343/702 |
| 3,946,390 | 3/1976 | Alexander et al. | 343/702 |
| 4,121,218 | 10/1978 | Irwin et al. | 343/702 |
| 4,598,295 | 7/1986 | Murphy | 343/702 |

*Primary Examiner*—Rolf Hille
*Assistant Examiner*—Hoanganh Le
*Attorney, Agent, or Firm*—Koda and Androlia

[57] ABSTRACT

An antenna system for a portable radiotelephone which does not require an expensive mechanical and bulky change-over switch to switch between the transmitting and receiving main antenna element and the call signal-receiving sub-antenna element. This is accomplished by a rod-shaped transmitting and receiving main antenna element within an antenna retaining mechanism so designed that the antenna element is free to slide in and out of the case of the radiotelephone. This case also houses a sub-antenna element which is in constant electrical contact with the antenna retaining mechanism. Conductive components in the elements provide the switching function, and one of them, a conductive tube, is constantly connected to the transmitter-receiver set in the case so that there is no deterioration of the characteristics of the main antenna element.

4 Claims, 3 Drawing Sheets

ANTENNA FOR A PORTABLE RADIOTELEPHONE

BACKGROUND OF THE INVENTION

1. Field of the Invention

The present invention relates to an antenna for a portable radiotelephone, and specifically to a means of switching between a transmitting/receiving main antenna element installed inside the case of the portable radiotelephone, from which the antenna may be freely withdrawn or re-inserted and a call signal-receiving sub-antenna element installed inside the case.

2. Prior Art

As is known, telephones are instruments which are used for two-way communication, and portable radiotelephones are also used in this way. In telephones it is absolutely impossible to predict when a call signal will be received from a calling party. Accordingly, in conventional portable radiotelephones, the antenna element is fixed so that it constantly projects outside the case of the portable radiotelephone to insure that a call signal can always be received. Thus, the antenna element projects from the case even when the radiotelephone is not in use. Accordingly, the antenna element may therefore create a nuisance.

FIG. 3 shows a conventional portable radiotelephone with a main transmitting and receiving antenna element 21 which can be freely inserted into or withdrawn from the case 20. When the radiotelephone is not in use, the main antenna element 21 can be accommodated inside the case 20. At the same time, a call signal receiving sub-antenna element 22 is installed inside the case 20. When the main antenna element 21 is inside the case 20, the sub-antenna element 22 is actuated by a change-over switch 23 linked to the inserting/withdrawing action of the main antenna element 21.

An antenna constructed as described above operates as follows: When the main antenna element 21 is located inside the case 20 as indicated by the broken line in FIG. 3, the change-over switch 23 is switched to side a by a driving means (not shown in the Figure) such as a spring. The switch 23 thus causes the sub-antenna element 22 to be connected to the transmitter-receiver set 24. When the main antenna element 21 is extended to the outside of the case 20 as indicated by the solid line in FIG. 3, an actuator 26 is pushed in the direction indicated by the dotted arrow in FIG. 3 by a projection 2 installed at the base end of the main antenna element 21, so that the change-over switch 23 is switched to side b. As a result, the main antenna element 21 is connected to the transmitter-receiver set 24.

An antenna assembly constructed as shown in FIG. 3 suffers two principal drawbacks: First, the system is constructed so that switching between the transmitting and receiving main antenna element 21 and the call signal-receiving sub-antenna element 22 is accomplished by means of a change-over switch 23 which has a mechanical contact. This conspicuously deteriorates to the antenna characteristics in a portable radiotelephone of this type (which uses ultrashort waves). Second, the changeover switch 23 is a square device occupying at least 1 to 3 $cm^3$, a considerable amount of space. Furthermore, such a switch is expensive, tending to increase the overall cost of the radiotelephone.

SUMMARY OF THE INVENTION

Accordingly, the object of the present invention is to provide an antenna for a portable radiotelephone in which switching between the main antenna element and sub-antenna element can be accomplished without using a change-over switch, there is no deterioration of antenna characteristics, the space occupied by the parts is small and manufacturing costs are low.

The present invention is designed to solve the above described problems and achieve the above described object. In doing so the present invention employs an antenna with a rod-shaped transmitting and receiving main antenna element equipped with a feeding conducting part at its base so installed that it can be freely inserted into or withdrawn from the case of a portable radiotelephone. An antenna retaining mechanism holds the main antenna element so that the element is free to slide, is equipped with a conductive tube which can maintain a state of electrical continuity with the feeding conductive part of the main antenna element, and is connected to a transmitter-receiver set via a matching device. A sub-antenna element is installed inside the case with one end, which consists of a conductive elastic part, constantly pressed against the circumference of the conductive tube of the antenna retaining mechanism, so installed that call signals from calling parties can be received. The antenna also includes a means of separating the end of the subantenna element consisting of a conductive elastic part from the conductive tube when the main antenna element is extended from the case and used.

As a result of the construction described above, with the present invention it is possible to switch between the a transmitting and receiving main antenna element and the call signal-receiving sub-antenna element without using a change-over switch, as in conventional devices. Furthermore, since a conductive tube which acts as a feeding part is constantly connected to the transmitter-receiver set, the transmitting and receiving characteristics often main antenna element do not deteriorate.

DETAILED DESCRIPTION OF THE INVENTION

Figure 1:
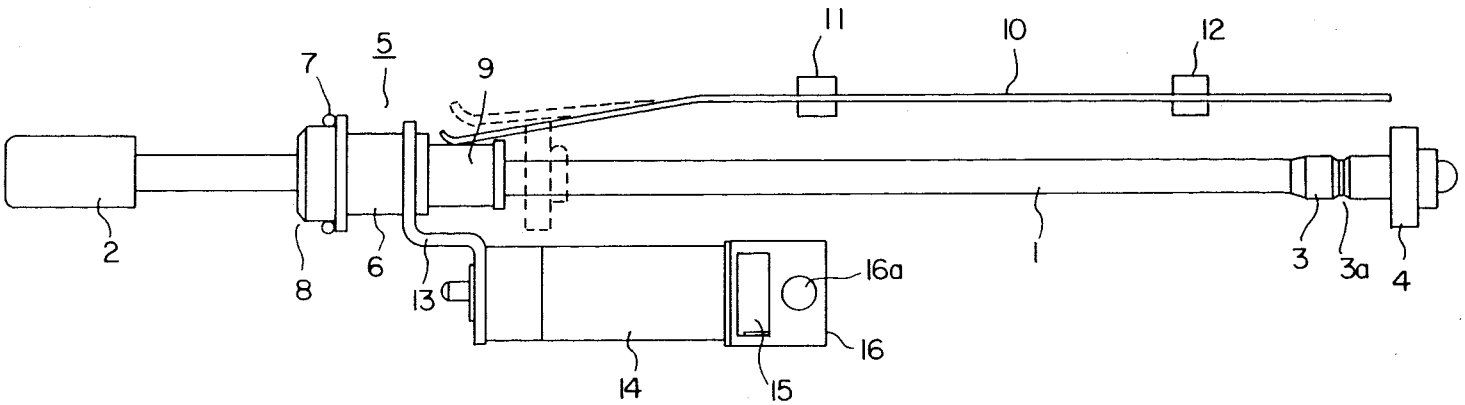
FIG. 1 illustrates the construction of one embodiment of the present invention.

FIG. 1 illustrates one embodiment of the antenna of the present invention. The main antenna element 1 is formed by covering the circumference of a flexible conductive wire (except at the base of the wire) with a cover consisting of a flexible insulating material, such as a synthetic resin, in order to eliminate the deleterious effects of static electricity. This is an antenna element for ultrashort wave transmission and reception, whose overall length is set at approximately 3/8 of the wavelength involved. A cap 2, which is used both to operate the antenna element and to provide protection from danger, is fastened to the tip of the main antenna element 1. A cylindrical stopper 3 which consists of a conductive material is installed at the base of the main antenna element 1 so that the stopper 3 is in a state of electrical continuity with the flexible conductive wire.

A groove 3*a* which acts as a feeding conductive part is formed around the circumference of the stopper 3 in the central portion of the stopper 3. A disk-shaped cam 4, formed from an insulating material such as a synthetic resin, is fastened to the base of the stopper 3.

The main antenna element 1, constructed as described above, is passed through an antenna retaining mechanism 5, and is held by this mechanism so that it is free to slide to the right and left in FIG. 1. The antenna retaining mechanism 5 consists of: A cylindrical fastening part 6 which is used to fasten the mechanism 5 to the case; a water-proof cap 8 equipped with an O-ring 7 to prevent water from seeping into the interior of the case, and a conductive tube 9 which has on its interior circumferential surface an engaging part (not shown in the figures) capable of maintaining a state of electrical continuity with groove 3*a* which acts as the feeding conductive part of the main antenna element 1.

A sub-antenna element 10 is provided to allow reception of call signals from calling parties. This sub-antenna element 10 consists of a long, slender leaf-shaped conductive elastic part, and is installed inside the case by fastening elements 11 and 12 so that it is parallel to the main antenna element 1. One end of this sub-antenna element 10 is bent toward the conductive tube 9 so that the tip of this end is constantly pressed against the outer circumferential surface of the conductive tube 9 in the antenna retaining mechanism 5. When the main antenna element 1 is extended outside of the case for use, i.e., when the main antenna element 1 is moved to the left in FIG. 1, the bent end of the sub-antenna element 10 is pushed upward (as indicated by the broken line in FIG. 1) by the cam 4 installed on the base of the stopper 3, so that the bent end is separated from the conductive tube 9.

Furthermore, the size, position and other characteristics of the cam 4 are set so that the timing of the separation of the sub-antenna element 10 from the outer circumferential surface of the conductive tube 9 more or less coincides with the timing of the connection of the groove 3*a* in the main antenna element 1 to the conductive tube 9.

One end of the matching device 14 is connected to the conductive tube 9 via a conductor 13. This matching device 14 is a device of universally known construction which is used in order to insure impedance matching between the antenna elements 1 and 10 and the transmitter-receiver set. The other end 15 of this matching device 14 is connected to the transmitter-receiver set (not shown in FIG. 1). Further, matching device 14 includes a combination ground conductor and fastening plate 16 with a fastening hole 16*a*.

Next, the operation of the antenna constructed as described above will be described with reference to FIGS. 2*a* and 2*b*.

Figure 2A:
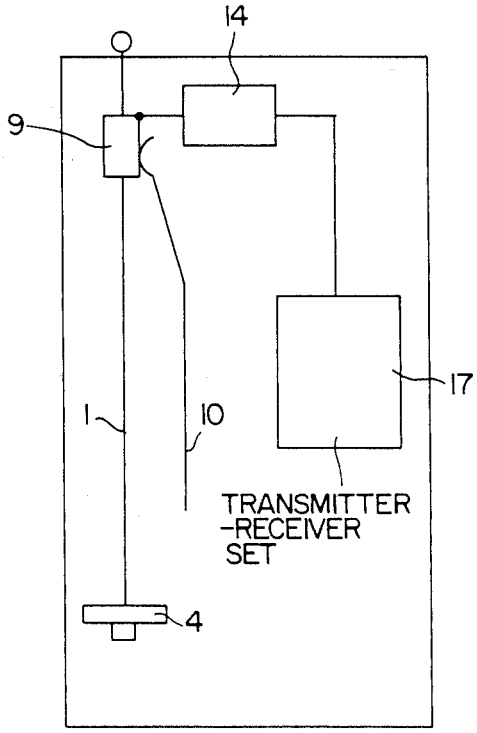
FIGS. 2*a* and 2*b* are explanatory diagrams which illustrate the operation of the same embodiment.

First, when the main antenna element 1 is inside the case, the cam 4 is positioned at the bottom of the case as shown in FIG. 2*a*. Accordingly, one end of sub-antenna element 10 is in contact with the conductive tube 9 of the antenna retaining mechanism 5. At this time, because the groove 3*a* of the main antenna element 1 is separated from conductive tube 9, the electrical connection between the conductive tube 9 and main antenna element 1 is interrupted. Accordingly, only the sub-antenna element 10 is connected to the transmitter-receiver set 17. In this state, a call signal arriving from a calling party is received by the sub-antenna element 10 and a calling sound is generated by the transmitter-receiver set 17.

Figure 2B:
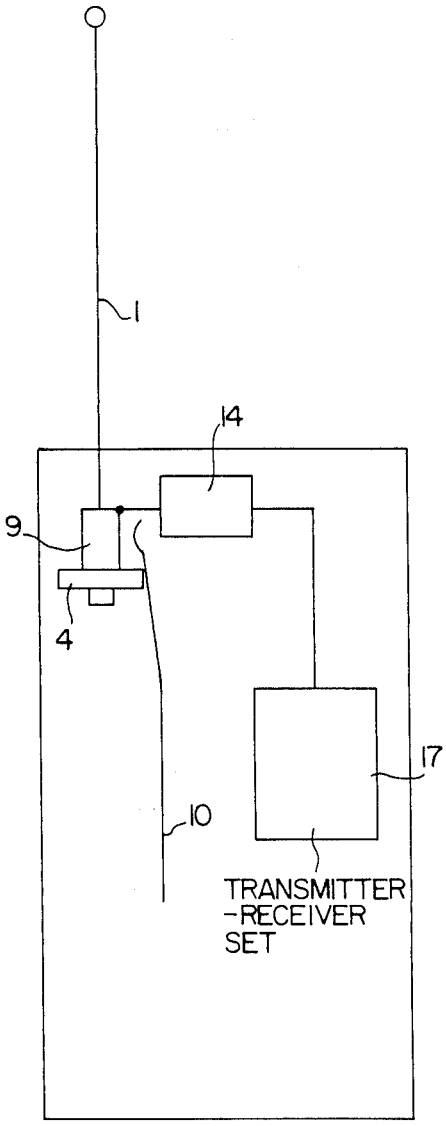
Figure 3:
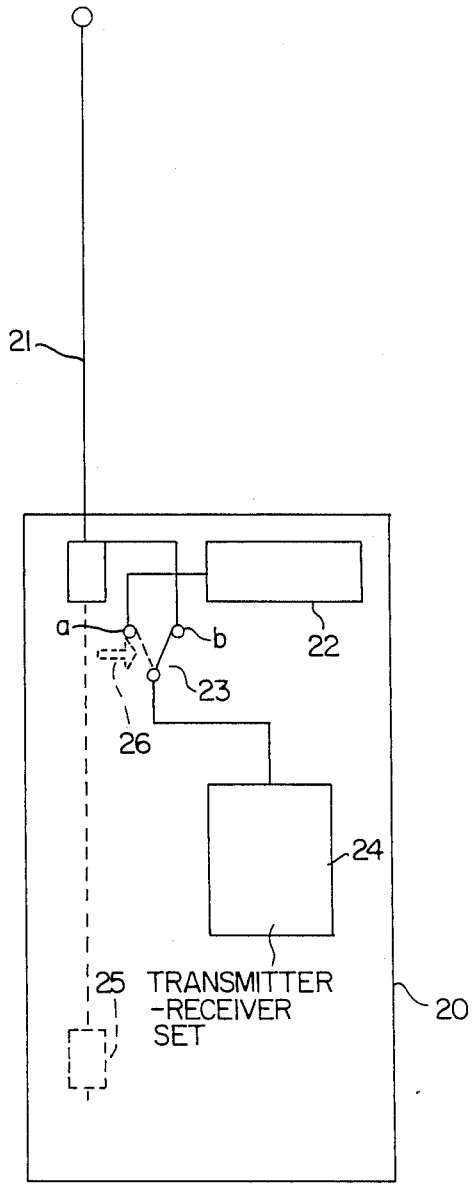
FIG. 3 PRIOR ART
FIG. 3 is a schematic illustration of the construction of a conventional prior art example.

When the main antenna element 1 is extended and operated in response to the calling sound, the cam 4 moves to a prescribed position. As a result, the sub-antenna element 10 is separated from the outer circumferential surface of the conductive tube 9 by the movement of the cam 4 as shown in FIG. 2*b*. At this time, the groove 3*a* in the stopper 3 of the main antenna element 1 engages with the engaging part formed on the interior circumferential surface of conductive tube 9, so that the conductive tube 9 and main antenna element 1 are in a state of electrical continuity. Accordingly, now only the main antenna element 10 is connected to the transmitter-receiver set 17. In this state, radio-telephone communication can be accomplished by transmitting and receiving electromagnetic waves using the main antenna element 1.

Furthermore, since the groove 3*a* in the stopper 3 and the engaging part inside the conductive tube 9 are engaged with each other, the main antenna element 1 and conductive tube 9 are electrically connected, and also extension of main antenna element 1 is maintained in a mechanically stable state. Furthermore, the operator of the radiotelephone can confirm that the main antenna element 1 is fully extended (i.e., that the main antenna element 1 is "on") by the feel of the antenna at the time of engagement. Moreover, since reception by the sub-antenna element 10 continues until the main antenna element 1 connects with the transmitter-receiver set 17, there is no interruption of the calling sound while the main antenna element 1 is being extended even in cases where the transmitter-receiver set 17 contains no call-signal holding circuit. Furthermore, since the sub-antenna element 10 in this embodiment is a long, slender leaf-shaped element, and since this element 10 is installed roughly parallel to the main antenna element 1, the "dead space" inside the case can be utilized by the antenna. In addition, this antenna is not grounded and has a matching device. Compared to conventional grounded antennas, this antenna is not greatly affected by ambient conditions, and is therefore capable of stable transmission and reception.

The present invention is not limited to the embodiment described above. For example, a copper foil of a prescribed length could be installed in band form on a printed circuit board inside the case and this could be used as a portion of the subantenna element 10. Alternately, a conductive foil pasted to the outside of the case as a name-plate, etc., could similarly be used as a portion of sub-antenna element 10. Furthermore, a matching device 14 could also be formed on a printed substrate. Moreover, the main antenna element 1 could also be equipped with a loading coil. It goes without saying that various other modifications are possible without departing from the spirit of the present invention.

The present invention thus provides an antenna for a portable radiotelephone which makes it possible to switch between the main antenna element and the sub-antenna element without using a change-over switch, in which there is no deterioration of the antenna characteristics, occupies little space, and can be inexpensively manufactured.

I claim:

1. An antenna system for a portable radiotelephone comprising:

a rod-shaped transmitting and receiving main antenna element which is freely inserted into and withdrawn from a case of said portable radiotelephone, said antenna element having a first conductive means at its base;

an antenna retaining mechanism which holds said main antenna element so that said main antenna element is free to slide, said antenna retaining mechanism being equipped with a second conductive means which is electrically coupled with said first conductive means only when said main antenna element is withdrawn from said case and is thereby connected with a transmitter-receiver set via a matching device;

a sub-antenna element provided within said case for receiving call signals from calling parties, one end of said sub-antenna element being made of a conductive elastic material and being biased into electrical contact with said second conductive means of said retaining mechanism; and a means for separating said one end of said sub-antenna element from said second conductive means of said retaining mechanism when said main antenna element is withdrawn from said case, whereby said sub-antenna element is disconnected from and said main antenna element is connected to said transmitter-receiver set.

2. An antenna system according to claim 1 wherein said first conductive means is a feeding conductive part.

3. An antenna system according to claim 2 wherein:

said second conductive means is a conductive tube;

said sub-antenna element is made from a conductive elastic material; and one end of said sub-antenna element is biased against the circumference of said conductive tube.

4. An antenna system according to claim 1 wherein said second conductive means is a conductive tube.

* * * * *